United States Patent [19]

Kaufman et al.

[11] 3,986,436

[45] Oct. 19, 1976

[54] AXIAL-PISTON ENGINE

[76] Inventors: Mikhail Semenovich Kaufman, ulitsa Bolshakova, 145, kv. 43; German Viktorovich Demin, Uktus, pereulok Korotky, 9/20, both of Sverdlovsk, U.S.S.R.

[22] Filed: Oct. 6, 1975

[21] Appl. No.: 620,122

Related U.S. Application Data

[63] Continuation of Ser. No. 512,612, Oct. 7, 1974, abandoned, which is a continuation of Ser. No. 427,118, Dec. 21, 1973, abandoned.

[52] U.S. Cl. ..... 91/502; 91/503

[51] Int. Cl.[2] ..... F01B 3/04

[58] Field of Search ..... 91/502, 503; 417/269

[56] References Cited

UNITED STATES PATENTS

| | | | |
|---|---|---|---|
| 2,095,255 | 10/1937 | Holmes | 91/503 |
| 2,545,609 | 3/1951 | Engstrom | 91/503 |
| 2,925,047 | 2/1960 | Hoffer | 91/502 |

FOREIGN PATENTS OR APPLICATIONS

| | | | |
|---|---|---|---|
| 1,951,789 | 6/1970 | Germany | 91/502 |
| 2,004,773 | 8/1971 | Germany | 91/498 |
| 183,075 | 9/1966 | U.S.S.R. | 91/498 |
| 211,324 | 4/1968 | U.S.S.R. | 91/503 |

*Primary Examiner*—William L. Freeh
*Attorney, Agent, or Firm*—Holman & Stern

[57] ABSTRACT

An axial-piston engine wherein the shaft has a circular groove for feeding a working medium, the groove provided on one side from a wave-like cam, as well as a circular groove for draining off the working medium, provided on the other side from the wave-like cam; the circular groove for feeding the working medium communicates with longitudinal ducts for feeding the working medium; the longitudinal ducts intercommunicate by means of transverse ducts provided in the zone of the circular groove for feeding the working medium and by means of transverse ducts in the zone of the shaft ports provided on the side of the circular groove for draining off the working medium; the circular groove for draining off the working medium communicates with the longitudinal ducts for draining off the working medium; the latter longitudinal duct are connected with each other by means of transverse ducts in the zone of the circular groove for draining off the working medium and transverse ducts in the zone of the shaft ports provided on the side of the circular groove for draining off the working medium.

1 Claim, 8 Drawing Figures

AXIAL-PISTON ENGINE

This is a continuation of application Ser. No. 512,612 filed Oct. 7, 1974 which in turn is a Continuation of Ser. No. 427,118 filed Dec. 21, 1973 both of which are now abandoned.

FIELD OF THE INVENTION

The present invention relates generally to engines intended for the conversion of the energy of a working medium into mechanical work and more particularly it relates to multiple-acting axial-piston engines.

The present invention can be most effective when used for driving cutting-and-loading machines using compressed air under 3–8 atm, such as loading and loading-delivery machines, drilling rigs and carriages, development machines, charging machines, and lift winches.

In mining engineering, wide use is made of radial-axial pneumatic engines with a crank and connecting-rod converting assembly. Their principal disadvantages are expanded dimensions and low economy due to considerable spacing of the piston heads from the central distributor. Efforts to reduce the dimensions by changing cranks for links failed to produce efficient engines. Unlike radial-axial engines, axial-radial ones feature dimensions two times smaller in any of the three directions and, consequently, volumes eight times smaller, their power being equal.

Known presently in the art is an axial-piston engine in which double-acting pistons are arranged in cylinders parallel to the shaft, equidistantly spaced from the latter. Inside each of the pistons, there is a roller interacting with the guiding face of a wave-like cam set on the engine shaft. The wave-like cam is intended for conversion of the reciprocating motion of the pistons into the shaft rotation. The distribution of the working medium – compressed air, its supply to and removal from the cylinders is carried out through a distributing system made as a combination of duct provided in the shaft and the body. The compressed air is supplied to the cylinders through the distributing system. Under the action of this compressed air, the pistons move axially and their rollers interact with the face of the wave-like cam, turning the latter. Thus, the progressive motion of the pistons is transformed into the shaft rotation.

The compressed air supplied to the engine covers a long distance before it reaches the working chamber of the cylinder. The known engine fails to ensure an increase in power without an expansion of its own dimensions, as power increase can be gained only through expansion of the clear openings of ducts designed to take compressed air to the working chambers of the cylinders and discharge it therefrom. The expansion of the clear openings of the ducts, on condition the shaft strength should remain secure, result in the increased dimensions of the shaft and, consequently, of the engine as a whole. Furthermore, the length of the ducts through which compressed air is supplied to the working chambers of the cylinders causes a large loss in the air pressure therein, which adversely affects the engine efficiency.

The known designs fail to ensure further reductions in the dimensions of the engine without affecting its power, as an increase in the clear openings of the ducts with the retention of the strength of the shaft in which the ducts are provided tends to expand its dimensions.

Commonly known is an axial-piston engine whose body made up of two semiblocks incorporates cylindrical spaces arranged parallel to the shaft axis at an equal spacing from it. The spaces house double-acting pistons which are fitted with rollers secured with the aid of bushes. Set on the engine shaft is a wave-like cam with a curvilinear face.

The wave-like cam is intended for conversion of the reciprocating motion of the pistons into the rotation of the shaft. The rollers interact with the curvilinear faces of the wave-like cam.

The distribution of the working medium – compressed air, its supply to the working chambers of the cylinders and removal from the after piston chambers is effected through an air-distributing system. The air-distributing system is formed as a combination of longitudinal ducts for the delivery and eduction of compressed air, in the shaft, and ports communicating the ducts for the delivery of compressed air with the working chamber of the cylindrical space and ports communicating the ducts for the eduction of compressed air from the after piston chambers of the cylindrical spaces, and a combination of ducts formed in an air-supply box. The air-supply box is fixed to the body so that an inlet duct of the box communicates with a central inlet duct provided in the shaft. The central duct communicates, in its turn, with the working chambers of the cylinders by means of shaft ports intended for the admission of compressed air. The afterpiston chambers of the cylinders communicate, by means of the outlet ports in the body and the shaft, with the outlet longitudinal ducts provided in the shaft and communicating with the outlet duct of the air-distribution box. The number of longitudinal ducts for the eduction of compressed air is equal to the number of the outlet ports in the shaft.

With the engine, described hereinabove, being in operation, compressed air goes, via the inlet duct of the distribution box, to the central longitudinal duct of the shaft, wherefrom the compressed air is supplied, through the inlet ports of the shaft and the inlet ports of the body, to the working chambers of the cylindrical spaces to exert pressure on the pistons. The latter make progressive motion. The rollers interact with the contact face of the wave-like cam, forcing it to rotate. From the afterpiston chamber, the compressed air escapes through the eduction ports in the body, the eduction ports in the shaft and the longitudinal ducts in the shaft, that are intended for discharging the compressed air, and therefrom — into the exhaust port of the air-distribution box.

In the above-described engine, the compressed air fed to the engine covers a long distance, flowing initially through the inlet duct of the air-distribution box, then through the central inlet duct of the shaft, through the inlet ports of the shaft, and the inlet ports of the body before it reaches the working chamber of the cylinder. The similar long distance is covered by the compressed air when it escapes from the afterpiston chamber of the cylinder. It should be noted that the longitudinal ducts through which the compressed air is released function independently, failing to provide conditions for unimpeded escape of the compressed air. All this results in losses of the compressed air pressure in the ducts.

The known engine fails to help gain a power increase without increasing its dimensions, as the power gain can be achieved only by expanding the passage areas of the ducts designed to deliver compressed air to the working chambers of the cylinders and to drain it off therefrom. The expanded passage areas of the ducts cause, in case the shaft strength is to remain secure, an increase in the dimensions of the shaft and, consequently, of the engine as a whole. Besides, the length of the ducts through which air is supplied to the working chambers of the cylinders and drained off therefrom causes considerable loss in the air pressure therein, which reduces the engine efficiency.

The known design fails to ensure further reductions in the engine dimensions without affecting the power, as any expansion in the passage areas of the ducts, with the strength of the shaft in which the ducts are formed is not to be affected, leads to increasing its dimensions.

SUMMARY OF THE DISCLOSURE

An object of the present invention is to provide for an increase in the power of the axial-piston engine without increasing its dimensions.

Another object of the present invention is to help raise the efficiency of the axial-piston engine.

Yet another object of the invention is to ensure low metal consumption in producing the axial-piston engines.

According to the above-mentioned and other objects of the invention, the essence of the present invention consists in that in the body of the axial-piston engine in which there are cylindrical spaces whose axes are parallel to the axis of the shaft and equally spaced from the latter, each space housing a double-acting piston inside which there is at least one roller interacting with a wave-like cam set on the shaft in which there are provided longitudinal ducts for supplying a working medium and longitudinal ducts for draining off the working medium as well as ports communicating the above supply ducts with the cylindrical spaces and ports communicating the longitudinal drain-off ducts with the cylindrical spaces, according to the invention, the shaft has a circular channel for supplying the working medium, the channel spaced on one side from the wave-like cam and communicating with the longitudinal ducts for supplying the working medium, that communicate with each other by means of transverse ducts within the zone of said circular channel for supplying the working medium, as well as a circular channel for draining off the working medium, provided on the other side from the wave-like cam and communicating with the longitudinal ducts for draining off the working medium, that communicated with each other through other transverse ducts within the zone of the circular channel for draining off the working medium, the longitudinal ducts for supplying the working medium communicating with each other through transverse ducts within the zone of the shaft ports arranged from the side of the circular channel for draining off the working medium, whereas the longitudinal ducts for draining off the working medium communicate with each other by means of the transverse ducts within the zone of the shafts ports located from the side of the circular channel for supplying the working medium.

In the axial-piston engine of the invention due to the provision of the transverse ducts connecting the longitudinal ducts for supplying the working medium to the working chambers of the cylinders and the longitudinal ducts for draining off the exhaust working medium from the after-piston chambers of the cylinders, all the longitudinal ducts function to supply the working medium to the working chambers of the cylinders and to drain off the exhaust medium therefrom. As a result, when the piston makes a power stroke, there is a maximum supply of the working medium to the working chamber of the cylinder. At the same moment, the port for supplying the working medium in the body is opened to the maximum due to the calculated position of an inlet port provided on the shaft and an inlet port provided in the body and leading to the working chamber. Since the longitudinal inlet ducts are connected by means of the transverse ducts, the working medium is supplied through these transverse ducts from the other working ducts to that port which is in the maximum opening phase. Next moment, in the maximum opening phase is a port communicating with the working chamber of the other cylindrical space thus, all the pistons are supplied with air to the maximum, as a result of which the energy of the working medium is converted most effectively into the piston pressure transmitted via the rollers onto the curvilinear face of the wave-like cam. The above-described embodiment of the air-distributing system permits an increase, without expanding the passage area of the inlet and outlet ports, of the supply of compressed air to those working chambers which are most efficient at a particular moment. This helps increase the power (efficiency) of the engine without increasing its dimensions.

A shorter path covered by the compressed air on its way to the working chamber and from the after-piston chamber to the exhaust port, permits reduction of losses in the compressed air pressure and thus raise the engine efficiency.

The limited dimensions of the engine and its compactness made possible due to the radial air-distribution system ensure limited metal usage when producing the engine.

BRIEF DESCRIPTION OF THE DRAWINGS

These and other objects and advantages of the invention will be more apparent from the detailed description of its exemplary embodiments and appended drawings, wherein.

DETAILED DESCRIPTION OF THE PREFERRED EMBODIMENT

Figure 1:
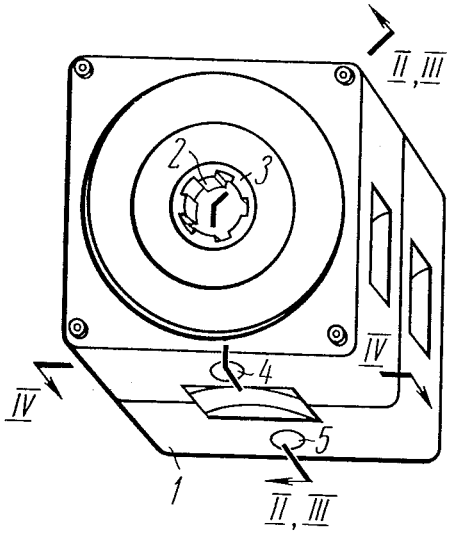
FIG. 1 shows an isometric view of an axial-piston, engine according to the invention.
Figure 2:
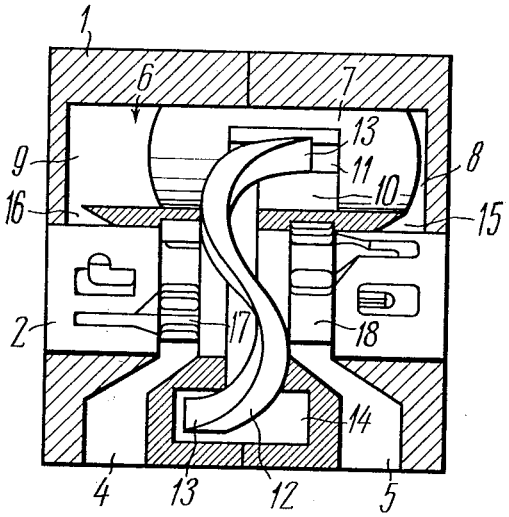
FIG. 2 is a longitudinal section view of the axial-piston engine taken along line II—II of FIG. 1.

A body 1 (FIG. 1) of the axial-piston engine of the invention comprises two monolithic semiblocks. The body 1 houses a shaft 2 with axial grooves 3 by which the shaft 2 is connected with mechanisms actuated by the engine. The body 1 has a supply or inlet port 4 for supplying compressed air and a drainage of exhaust port 5 for draining off the exhaust compressed air. Provided inside the body 1 are cylindrical spaces 6 (FIG. 2 and 4) accommodating pistons 7 that divide the spaces 6 into a working chamber 8 and an afterpiston chamber 9. The axes of the cylindrical spaces 6 and of the pistons 7 housed therein are parallel to the axis of the shaft 2 and are spaced at equal distances from the axis. The pistons 7 have axial slots 10 fitted with rollers 11. Formed with the shaft 2 is a wave-like cam 12 with guiding faces 13 on opposite sides. The rollers 11 are in contact with the guiding faces 13 of the wave-like cam 12 which waves 13 mesh into the slots 10 of the pistons 7 permitting the passage of the waves of the cam 12 during the rotation of the shaft 2, are axial grooves 14.

In order to ensure the supply of compressed air to the working chamber 8, there are ports 15 in the body 1. During the back or reverse stroke of the piston 7, the ports 15 serve exhaust air from the chamber 8. For the discharge of the exhaust air from the afterpiston chamber 9, there are ports 16 in the body 1. During the back stroke of the piston 7, the ports 16 serve to admit compressed air to the chamber 9. Provided on the shaft 2 in the zone of the port 4 for supplying compressed air to the engine is a circular (annular) channel 17 and in the zone of the port 5 for exhausting compressed air is a circular (annular) channel 18.

Figure 3:
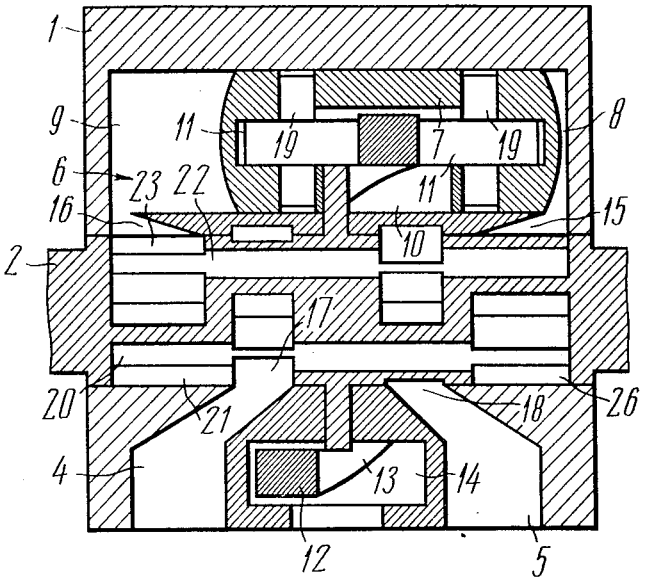
FIG. 3 shows the axial-piston engine through line III—III as of FIG. 1.

The rollers 11 are journaled in the body of the pistons 7 by axles 19 (FIG. 3).

Figure 4:
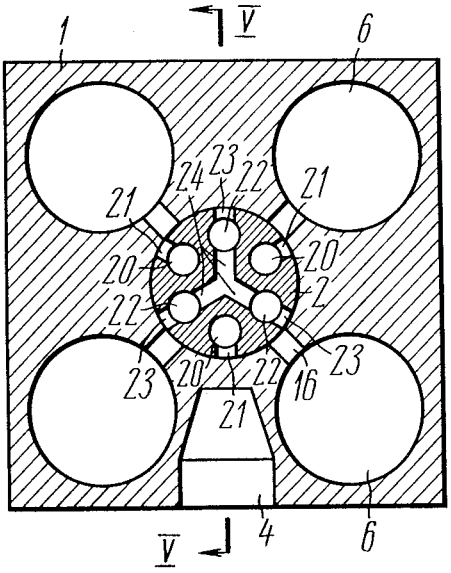
FIG. 4 is a cross-section of the axial-piston engine taken along the line IV—IV of FIG. 1.
Figure 5:
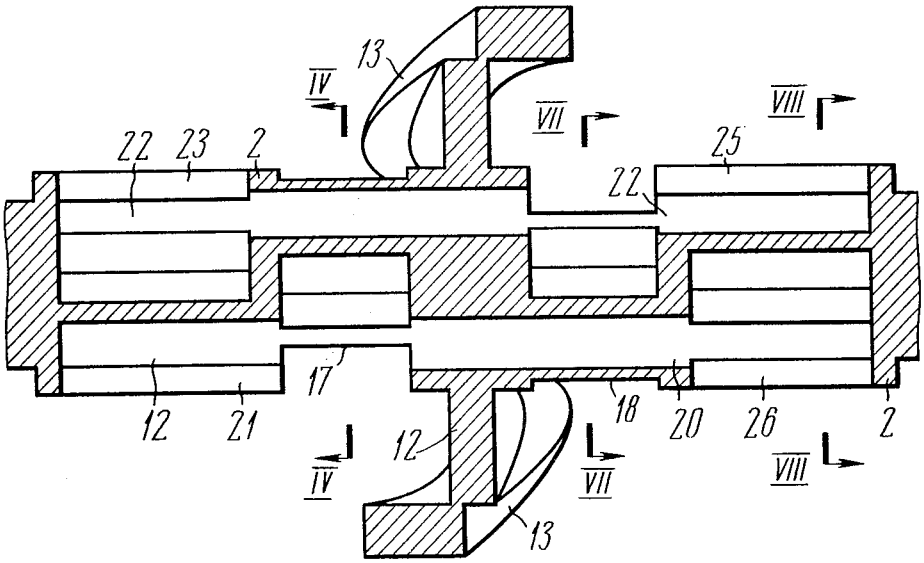
FIG. 5 is an enlarged longitudinal section of the shaft of the axial-piston engine taken along the line V—V of FIG. 4.

Throughout the length of the shaft 2 FIGS. 3-5) there are longitudinal ducts 20 for supplying compressed air; and the shaft 2 has ports 21 for admitting the exhaust compressed air to the space 6 through the ports 16. Provided in the shaft 2 throughout its length, there are also longitudinal ducts 22 for draining (exhausting) the compressed air. The shaft 2 has ports 23 for discharging the compressed air from the space 6 through the ports 16. The longitudinal ports 22 for draining off the compressed air are interconnected by means of transverse ducts 24 (FIG. 4).

The longitudinal ducts 22 for draining off compressed air communicate with ports 25 (FIG. 5) formed in the shaft 2 to discharge the compressed air from the cylindrical space 6 (FIG. 3) through the ports 15. The longitudinal ducts 20 (FIG. 5) for supplying compressed air communicate with ports 26 formed in the shaft 2 to admit the compressed air to the cylindrical space 6 (FIG. 3) through the ports 15.

Figure 6:
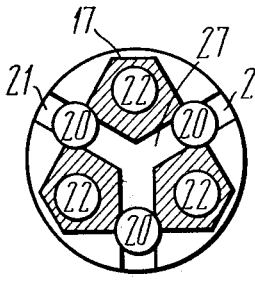
FIG. 6 is a cross-section of the shaft of the axial-piston engine taken along line VI—VI of FIG. 5.
Figure 7:
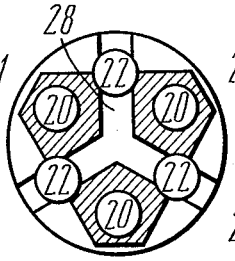
FIG. 7 shows the cross-section of the shaft of the axial-piston engine through line VII—VII as of FIG. 5.

The longitudinal ducts 20 for admitting compressed air are interconnected by means of transverse ducts 27 (FIG. 6). The longitudinal ducts 22 for draining off the compressed air are interconnected by means of transverse ducts 28 (FIG. 7).

Figure 8:
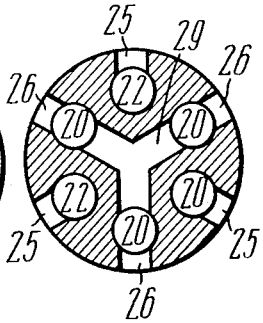
FIG. 8 is a cross-section of the shaft of the axial-piston engine taken along line VIII—VIII of FIG. 5.

The longitudinal ducts 20 for admitting compressed air are interconnected by means of transverse ducts 29 (FIG. 8).

The cross-sections of the air admission ports 26 (FIG. 5) provided in the shaft 2, in that part of the engine where the eduction port 5 is formed, as well as the cross-sections of the compressed air admission ports 21 (FIG. 3) provided in the shaft 2, in that part of the engine where the inlet port 4 formed, are oppositely inclined. The cross-sections of the eduction ports 23 and 25 (FIG. 3) spaced in the different ends of the shaft 2 are oppositely inclined as well.

OPERATION

The axial-piston engine operates as follows. Through the port 4 (FIG. 3) for feeding compressed air, the compressed air is supplied to the circular (annular) groove 17 and therefrom the compressed air enters directly into the longitudinal ducts 20 from the latter, the compressed air propagates to either side of the shaft 2. To the ports 21 which admit the compressed air to the ports 16 in the body 1, the compressed air being directly supplied from the circular groove 17, to the admissions ports 26 of the shaft 2, the compressed air is supplied through the longitudinal ducts 20. In the position shown in FIG. 8, the chamber 3 is the working chamber prior to the moment the compressed air is supplied thereto, while the chamber 9 is the afterpiston chamber. This is achieved through the preset inclination of the cross-sections of the port 21 and 26 and the ports 23 and 25.

Admitted to the chamber 8 of the cylindrical space 6, the compressed air exerts pressure on a piston 7 and moves axially. The force of the piston 7 is transmitted, via the roller 11, on to the guiding face 13 of the cam 12 and, as the guiding face curvilinear, causes the cam 12 rotate. The maximum admission of the compressed air to the working chamber 8 is effected at the maximum matching of the compressed air inlet ports 26 in the shaft 2 and of the compressed air inlet ports 15 in the body 1. During this moment, the piston 7 presses, through the roller 11, on a portion of the guiding face 13 of the cam 12 where the steepness of the wave is maximum; such position is precalculated. At the very same moment, to attain the operation of the piston 7 most efficient, maximum supply of compressed air to the working chamber 8 is required. This is achieved through connecting the longitudinal ducts 20 in the shaft 2 by means of transverse ducts 27 (FIG. 6) in the zone of the circular groove 17 (FIG. 5) and the transverse ducts 29 (FIG. 8) in the zone of the admission ports 26 located in the zone of the admission ports 15 (FIG. 3) provided in the body 1. To the admission ports 26 in the shaft 2 and to the admission ports 15 in the body 1 at the moment when they are at maximum matching, compressed air is supplied through all the three longitudinal ducts 20 due to their connection by means of the transverse inlet ducts 27 (FIG. 6) and 29 (FIG. 8). This permits to secure maximum effect in transmitting the compressed air pressure on the piston 7 (FIG. 3) and converting it into a torque on the shaft 2.

From the afterpiston space 9, the compressed air is discharged, through the eduction ports 16 in the body 1 and the eduction ports 23 in the shaft 2, into the discharging ducts 22 and therefrom further into the circular groove 18 in the shaft 2, and the port 5 for draining (exhausting) the compressed air from the engine.

The connection of the longitudinal ducts 22 by means of the transverse ducts 24 (FIG. 4) and 28 (FIG. 7) is conducive to a more complete drain-off (exhaust) of the compressed air through the eduction ports 16 (FIG. 3) in the body 1 and through the eduction ports 23 in the shaft 2 at the moment of their maximum matching.

To permit the start of the engine from any position and to provide for a more even torque, the number of the pistons is normally assigned non-multiple to the number of the cam waves, and therefore, at any moment of time, the pistons 7 are in mismatching travel phases and the ports 15 in the body 1 are in mismatching opening phases.

The mechanism adopted in the above-described engine to convert the reciprocating motion of the pistons 7 into the uniform rotation of the shaft 2 around the axis parallel to them operates, at a time, as a reducer with a gear ratio of 3. Therefore, the axial-piston engine of the invention affords and features a high torque and yields its power from the output shaft without the necessity of further transformation, which is favorable for further utilization.

The long service life of the converting cam mechanism of the engine is achieved by employing rolling bearings that help reduce the wear and by high-frequency technique of grinding the butt and track of the cam, that helps reduce dynamic loads in the mechanism.

The engine described hereinabove features a high adaptability to different operating conditions, preserving its rated power within a dual range of variations in the r.p.m of the shaft 2, and a degraded inertia when acceleration to maximum is achieved within as little as 0.005 sec.

The engine which includes the shaft 2 and the shaft has two output ends each having the axial socket and inner grooves 3 which do not protrude beyond the face walls of the body 1, which permits versatile and different layout variants in engine-fitted machines, facilitating their connection with stopping devices and other units, as well as with each other in case power increase is required.

Compared with similar radial-piston engines, the axial-piston engine of the invention, if used, reduces the weight and the material use ratio from 1.5 to 10 times for different standardized models.

A practical advantage of the proposed air distribution system of the axial-piston engine consists in that its adoption permitted an increase in the power of the axial-piston pneumatic engines by 66 percent, the dimensions of the distributor remaining unchanged, and reduced the specific consumption of compressed air by 12 percent at the same time due to eliminating losses in the pressure in the distributor.

What we claim is:

1. An axial-piston engine comprising: a body; a shaft accommodated in said body; said body having cylindrical spaces provided therein, said spaces having axes which are parallel to the axis of said shaft and being spaced equally from said axis; double-acting pistons, each piston being respectively housed in one of said cylindrical spaces and defining opposed working and after-piston chambers; a wave-like cam for converting the reciprocating motion of said piston into the rotation of said shaft, said cam having curvilinear faces and being fixed on said shaft; at least one roller disposed inside said piston and interacting with said curvilinear faces of said wave-like cam; said shaft having longitudinal ducts for feeding a working medium; said shaft having additional longitudinal ducts for draining off the working medium; said shaft having ports to communicate said longitudinal ducts for feeding the working medium with said cylindrical spaces; said shaft having additional ports to communicate said additional longitudinal ducts for draining off the working medium with said cylindrical spaces; said shaft having a circular groove for feeding the working medium to said longitudinal ducts, said circular groove being disposed on one side of said wave-like cam to communicate with said longitudinal ducts for feeding the working medium; said shaft having transverse ducts to connect with each other said longitudinal ducts for feeding the working medium in the zone of said circular groove for feeding the working medium; said shaft having an additional circular groove for draining off the working medium from said additional longitudinal ducts, said additional circular groove being disposed on the opposite side of said wave-like cam to communicate with said additional longitudinal ducts for draining off the working medium; said shaft having second transverse ducts for connecting with each other said longitudinal ducts for draining off the working medium in the zone of said additional circular groove for draining off the working medium; said shaft having third transverse ducts for connecting with each other said longitudinal ducts for feeding the working medium in the zone of said ports of said shaft which are disposed on the side of said additional circular groove for draining off the working medium; and said shaft having fourth transverse ducts for connecting with each other said additional longitudinal ducts for draining off the working medium in the zone of said additional ports of said shaft which are disposed on the side of said circular groove for feeding the working medium.

* * * * *